United States Patent [19]

Potter

[11] 4,301,947

[45] Nov. 24, 1981

[54] QUICK AND ACCURATE AIMING DEVICE FOR AEROSOL DISPENSER

[76] Inventor: Glenn J. Potter, 1332 S. Hope St., Los Angeles, Calif. 90015

[21] Appl. No.: 120,697

[22] Filed: Mar. 31, 1980

Related U.S. Application Data

[63] Continuation-in-part of Ser. No. 917,934, Jun. 22, 1978.

[51] Int. Cl.[3] ..... B67D 5/06

[52] U.S. Cl. ..... 222/182

[58] Field of Search ..... 222/182, 394; 239/288, 239/288.3, 288.5; 137/382

[56] References Cited

U.S. PATENT DOCUMENTS

| | | | |
|---|---|---|---|
| 3,038,633 | 6/1962 | Foster | 137/382 X |
| 3,876,113 | 4/1975 | Trotta | 222/182 |
| 3,958,726 | 5/1976 | Trotta | 222/182 |
| 4,114,811 | 9/1978 | Loeffler | 239/288.5 |

*Primary Examiner*—Allen N. Knowles

[57] ABSTRACT

Tear gas spray can effectively ward off a robbery attack. However, in many cases, the great speed and the surprise employed by expert attackers allow too little time for mobilization and aiming of the canister. The present invention fits over the canister, dispensing with the cap, and supplies a guiding tunnel over the discharge button for the distal phalanx of the triggering digit. Various identifying configurations of the parts are furnished and utilized so that, by feel alone, the fitted canister, resting in the pocket or purse, may be quickly grasped, rotated, and positioned in the hand, and the triggering digit tip may be placed in the tunnel, so that the fitted canister may then be quickly brought out and used, the pointing of the digital phalanx at the assailant's face assuring that the jet reaches its mark as the discharge button is depressed.

6 Claims, 3 Drawing Figures

QUICK AND ACCURATE AIMING DEVICE FOR AEROSOL DISPENSER

QUICK & ACCURATE AIMING DEVICE FOR AEROSOL DISPENSER

This application is a continuation-in-part of my copending application Ser. No. 917,934 filed June 22, 1978.

Personal civilian defense utilizing sprays from tear gas canisters, together with the associated development of suitable equipment and aerosols, constitute a new art that is in a state of flux.

Robbers of pedestrians rely on the element of surprise, often sprinting up silently from behind and striking the victim down, whereupon the latter releases his or her grip on anything being held, in order to break the fall with the outstretched palms. Surprise can be cancelled out if the person chosen for a victim is alert enough to glance backward frequently and also carefully study those approaching from in front, while making sure that no suspect starts to pass at close range. On even a short walk, several suspicious-looking people may be seen; and the citizen depending on a side arm or knife for protection would create much public alarm if he drew his gun or knife at every slight hint of imminent danger. If, however, he relied on tear gas—Mace or the like—he could lift out the canister from a pocket time after time, or even carry the canister in the hand for a prolonged period without anyone's knowing for sure what was being carried and without causing dismay.

Unfortunately, if the cap is to be saved, both hands will be required for its removal, an awkward thing to accomplish if packages are also being carried. In addition, the canister must be rotated under direct vision if it is to be aimed accurately at the assailant's face. These manipulations lose so much time, while also demanding that the owner take his eyes off his attacker, that the latter is able to achieve his purpose quickly and abort the spray of tear gas. Aiming in the dark is particularly uncertain. Thus, the canister may be as useless as a gun residing in its holster.

I have invented a structure to be added to a tear gas canister, such that the combination can be oriented in the grasp by touch alone so that when it is raised and the triggering digital phalanx, preferably the thumb tip, is pointed at the attacker's face, the jet will be delivered there in a fail-safe manner, without the user once taking his eyes off the person attempting the assault.

The device is attached to the canister by an encircling band which grips it tightly. For such gripping, the band is formed or deformed slightly out of round. The device is put on the canister from above, the discharge button and crimped ferrule slipping through a ring situated above the band. This ring is too small for the canister, stopping its advance at the shoulder. Rising above the band is an arch which, with the sloping top of the discharge button that it encloses, produces a tunnel of proper size to admit the terminal phalanx of a triggering digit. Slope of the button makes the tunnel entrance larger on the side opposite the jet pore. A special notch in the band locks the pocket clip in a position exactly opposite the jet pore, making it easy for the palpating fingers to rotate the fitted canister the right amount for the triggering phalanx to align with and enter the tunnel at its wide opening. Beads or blunt serrations on the narrow tunnel opening help warn the owner that it is the wrong opening. Initially, the dispenser and its button can be rotated intentionally within the band until the jet pore will align and hold its position directly under the triggering distal phalanx; thus, when this anatomical member is pointed at the attacker's face, the jet will be accurately delivered with never a glance at the canister from the moment it is first grasped.

Restriction of the canister at its shoulder by the ring of the invention assures that no amount of telescoping force will reduce the size of the tunnel or depress the discharge button. The arch is broad enough to protect the button against accidental rotation or depression while being carried in the coat or pants pocket or the purse. The pocket must be empty of other objects so that nothing such as a key or pen can enter the tunnel and cause accidental discharge as the canister is being withdrawn. Loose fitting of the digital terminal phalanx in the tunnel reduces the split-second accuracy of aim. Compounding the problem, some women owners may insist on using the index finger rather than the thumb. A preferred solution to this problem is to snap into place at the time of purchase an insert, selected from a series of adapters having digital grooves of graded sizes, which insert is appropriate to the size of the chosen digit. Each substantially rigid insert has four short blunt pins well spaced apart on a single level near its bottom, which will fit into matching holes high on the limbs of the arch. The insert is shaped thin under the arch and is spaced away from it so as not to impinge on it when distorted during its insertion or removal.

In another embodiment, the arch is so shaped that the sides are planar and slanted as they approach each other on the way to their meeting at the top of the arch; thus, they are enabled to fit without looseness and to accurately guide triggering phalanges of various sizes, if the dispenser with its discharge button can be set more or less far into the frame of the invention. This adjustment is made possible by four parallel rows of holes in the limbs of the arch, two rows on a limb, for mounting the retaining ring at one level or another and thus guiding the tip of the digit into the tunnel closely beneath the apex of the arch. Four screws can be inserted through selected arch holes on a single level and tightened into appropriate threaded holes in the retaining ring.

The accompanying drawing helps clarify the description which follows of the presently preferred embodiment of my invention.

Figure 1:
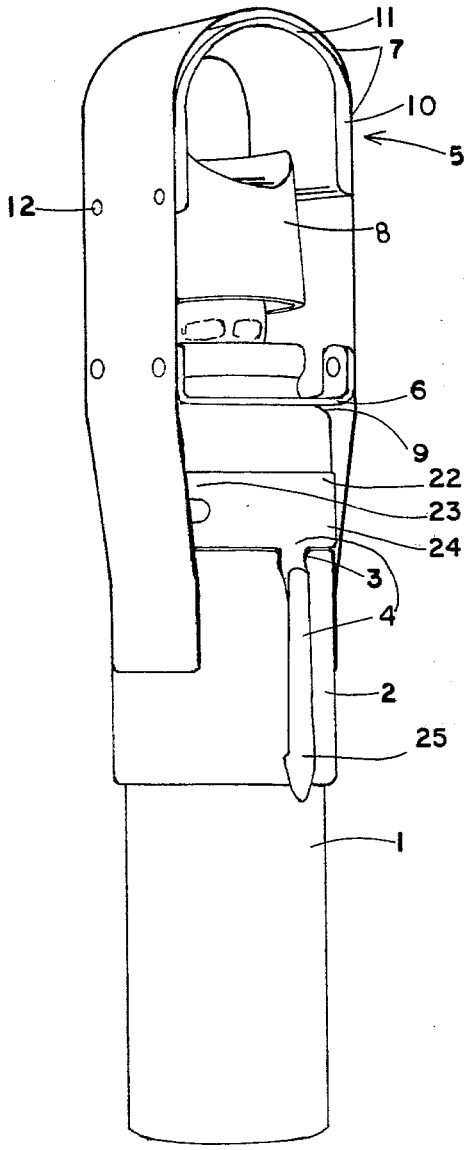
FIG. 1 is a view horizontally, partly from in back, partly from the left side, of the invention fastened on a standing canister.

The device is attached to the canister 1 by the encircling band 2. Notch 3 aligns the pocket clip 4, useful for determining by touch which way the jet pore faces and where the entrance 5 to the triggering tunnel is located, directly above. Used with my invention, it does not function as intended by the manufacturer. The simple, ordinary pre-existent pocket clip consists of an arch 22 comprised of two like arms 23, 24, which grasp by spring action the barrel of a pre-existant canister, and a median elongation or prong 25 integral with this arch and at right angles to it intended for gripping the cloth of one's pocket by pressure against the barrel of the canister. The canister 1 equipped with this pocket clip is of the type having a shoulder, a discharge button with a sloping top, and a crimped ferrule in between forming a neck.

Assembling is done in stages. The furnished pocket clip is first removed. Then the canister is inserted into the encircling band or sleeve of the invention. The arms of the arch of the pocket clip are next inserted into the space below the retaining ring 6, passing around and embracing the crimped ferrule which seals the mouth of the canister, and which is small enough not to spring the pocket clip out of shape. For this embracement, the dispenser is inserted only far enough for the crimped ferrule to appear in the space beneath the retaining ring 6. Thereafter, the canister is pushed as far in the invention as it will go, while the arms of the clip are worked down one after the other, a little at a time, over the resistive shoulder and down on the barrel of the canister, a screw driver tip being used to assist the maneuver.

The grip of the clip on the barrel helps to tightly stabilize the position of the dispenser in my invention. The median elongation or prong of the clip forms a ridge which is palpable by the thumb and useful in aligning the fitted dispenser in the grasp by feel alone.

Retaining ring 6 prevents advance of the canister too far into arch 7 region, where, otherwise, it would cause discharge button 8 to encroach upon the tunnel for the triggering digit. Shoulder 9 is too large to pass through the ring. Breadth of arch 7 protects the button against accidental rotation or depression.

Tunnel insert 10 has been snapped into place, narrowing the arch to fit a small thumb tip. The median region 11 of the insert is slightly removed from the under surface of arch 7 and thinned enough for resilient distortion during insertion; and the adapter is held rigidly in place by its four pins 12, filling holes in the arch.

Figure 2:
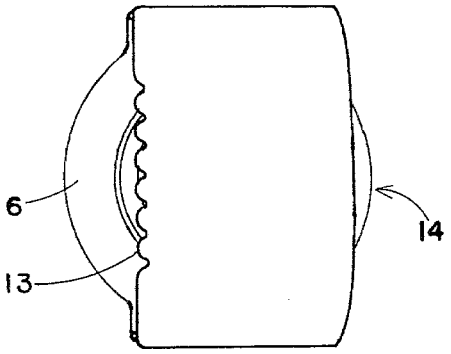
FIG. 2 is a view perpendicularly downward on a standing fitted canister.

In FIG. 2, beading 13 of the top front edge of the arch serves to warn that the opposite opening 14 is the right one for insertion of the thumb or finger. Retaining ring 6 extends outward sufficiently to be felt by the top grasping finger, which can thus be kept below the stream, when it issues from the jet pore.

Figure 3:
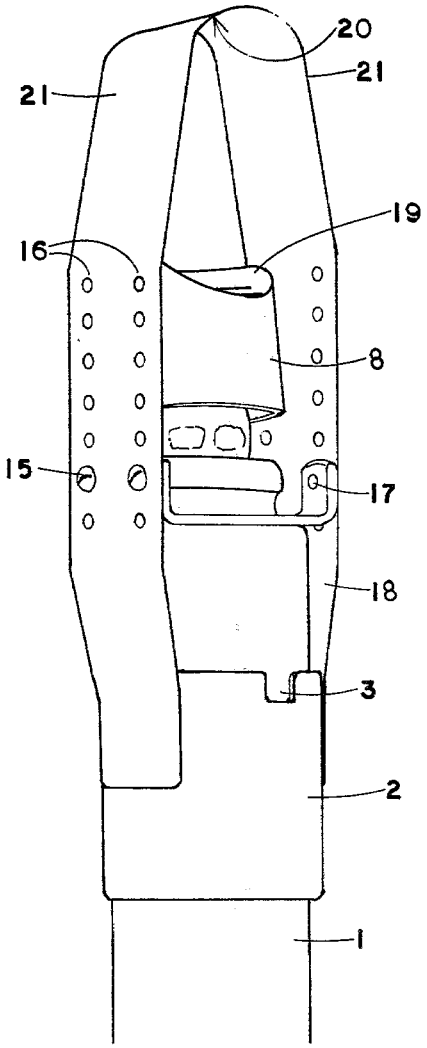
FIG. 3 is a view, similar to FIG. 1, of an alternative fitment for a canister.

In FIG. 3, four screws 15 are passed through holes selected from four rows of holes 16, and are tightened into four threaded holes 17 of retaining ring 6 for adjusting the degree of intrusion of the canister 1 and its discharge button 8 into fitment 18. As the canister is advanced farther in and fixed, the digital tunnel size is reduced as much as needed by the individual user, the top surface 19 of the button approaching the top 20 of the arch where the sloped planar side walls 21 of the arch approach closer and closer toward each other.

Notch 3 of band 2 maintains the constant rotational position of pocket clip 4 shown in FIG. 1 relative to the band.

The present invention, of course, may be carried out in other specific ways than those herein set forth without departing from the spirit and essential characteristics of the invention. The present embodiment is, therefore, to be considered in all respects as illustrative and not restrictive, and all changes coming within the meaning and equivalency range are intended to be embraced herein.

I desire to secure Letters of Patent of the United States.

I claim:

1. I claim an attachment to be put on aerosol dispenser canisters of the type having a shoulder, a discharge button with a sloping top, and a crimped ferrule in between forming a neck, particularly those spraying tear gas such as Mace, comprising:

a. an encircling band acting as the attachment proper, gripping such canister;

b. a retaining ring of a size to slip over the discharge button and crimped ferrule but holding back advance of said canister by not passing its shoulder; and c. an arch at the sides of and above said discharge button forming, with the sloping top of said button, a tunnel accommodating the distal phalanx of a triggering digit, thus providing accurate aiming means without the user's having to take his eyes off the assailant, and thus also protecting by its broadness against accidental rotation or depression of said discharge button; all three elements joined together in a rigid unit.

2. I claim the device of claim one wherein said encircling band is barely larger than said canister, and by being formed or deformed slightly out of round, fits said canister tightly enough to prevent accidental sliding and rotation, while yet allowing these motions when made intentionally; and wherein said band is notched along the top, mesially on the side below the entrance for the triggering thumb or finger, to accommodate the base of said canister's pocket clip when said clip is fully advanced downward against said band, for the purpose of orienting said canister in the hand just by the feel of said clip without the user's taking his eyes off a suspect.

3. I claim the device of claim one wherein a series of substantially rigid adapters graded as to size of tunnel groove cross-section so as to fit triggering distal phalanges of various sizes without looseness provide split-second accuracy of aiming, said adapters alike in other dimensions so that they all snap-fit into place beneath said arch, wherein four short blunt pins spaced far apart on a single level near the bottom of each of said adapters fit into four appropriately placed holes high on the limbs of said arch, and wherein each said adapter has its median region thinned and removed from said arch sufficiently that said adapter responds resiliently to distortion and permits the maneuver of snapping it into place.

4. I claim the device of claim one wherein said arch is so formed that said tunnel is sufficiently wedge-shaped in lengthwise section as to fit triggering distal phalanges of successively smaller sizes as the discharge button in the resting position is adjusted closer and closer to the top of said arch.

5. I claim the device of claim one wherein, for fitting said tunnel to various sizes of triggering distal phalanges thus assuring accuracy of aiming, said retaining ring has a plurality of threaded holes whereby it may be attached in any of a plurality of positions higher or lower on the limbs of said arch by a plurality of fitted screws each passed through a hole selected from a row of holes in said limbs, said rows matching up with said threaded holes; and wherein said retaining ring extends outward beneath said jet pore sufficiently to enable the user to identify said ring by touching it with the uppermost finger gripping said canister and to keep said finger below the jet stream being aimed at an attacker.

6. I claim the device of claim one wherein said arch at one opening, when taken with the slope of said discharge button, gives ample room for entry of the triggering digit, but which, at the other opening, which is located above the jet pore, it noticeably too small for easy insertion, wrongly, of said digit; and wherein said opening above the jet pore is beaded along the top edge for certain identification and avoidance by touch alone.

* * * * *